United States Patent [19]

Weiner et al.

[11] 3,995,399

[45] Dec. 7, 1976

[54] WIDE BELT GRINDING MACHINE INCLUDNG MEANS TO RELIEVE TENSION ON THE BELT IN CASE OF POWER FAILURE

[75] Inventors: Helmut Weiner, Springe; Kurt Fischer, Munder, both of Germany

[73] Assignee: Bison-werke Bahre & Greten GmbH & Co. KG, Germany

[22] Filed: July 14, 1975

[21] Appl. No.: 595,499

[30] Foreign Application Priority Data

July 16, 1974 Germany ..... 2434210

[52] U.S. Cl. ..... 51/148; 74/242.1 FP

[51] Int. Cl.[2] ..... B24B 21/00

[58] Field of Search ..... 51/135 R, 141, 148, 51/140; 74/242.1 FP, 242.1 A

[56] References Cited

UNITED STATES PATENTS

| | | | |
|---|---|---|---|
| 939,566 | 11/1909 | Taylor | 74/242.1 FP |
| 2,783,593 | 3/1957 | Hercik | 51/148 X |
| 3,491,488 | 1/1970 | Schaller | 51/148 X |
| 3,520,089 | 7/1970 | Owrey | 51/148 X |

*Primary Examiner*—Al Lawrence Smith
*Assistant Examiner*—Nicholas P. Godici
*Attorney, Agent, or Firm*—Craig & Antonelli

[57] ABSTRACT

A wide belt grinding machine which is provided with a control member to reverse, in the case of power failure, the pressure force effective on a piston which relieves the tension on an endless abrasive belt via a tensioning roll.

9 Claims, 3 Drawing Figures

WIDE BELT GRINDING MACHINE INCLUDNG MEANS TO RELIEVE TENSION ON THE BELT IN CASE OF POWER FAILURE

BACKGROUND OF THE INVENTION

The present invention relates to a wide belt grinding machine for boards, especially for wood panels, with at least one endless abrasive belt arranged above and/or below a plane in which the boards are moved. A machine of this general type is shown, for example, in Austrian Pat. No. 244,794, wherein each abrasive belt is driven by a motor and is tensioned by a tension roll that is connected with the piston of a piston-cylinder arrangement. The arrangement is under dual control by compressed air with the position of the cylinder piston being adjusted by means of a conventional control element such as a valve or the like.

Although wide belt grinding machines of the aforementioned type have proven themselves in commercial use, difficulties have been encountered from time to time as in the case, for example, of power failures or other electrical and mechanical disturbances which can lead to machine damage and abrasive belt damage. In such situations, serious trouble has been encountered if an abrasive belt comes into contact with any metallic parts because of spark production which gives rise to the possibility of a fire, especially since there is an ample spray of sparks in such instances. Occasionally, the so-called oscillatory control for constantly moving the abrasive belt to and fro at right angles to its travel direction fails to function properly and is usually also attributable to some electrical malfunction.

Any type of power disturbance which interrupts the operation of such a machine is inconvenient, particularly an electrical power failure. Even though the motors no longer receive any electrical current in the case of a power failure, the driven parts still continue to operate for a period of time. Thus, some provision has had to be made for including a pneumatically or hydraulically operated motor brake that would not be affected by an electrical power failure. Such motor brakes are, on the one hand, relatively expensive and themselves prone to disturbances, and, on the other hand, the time required for the complete arresting of the abrasive belts is too long due to the large rotating masses to prevent with certainty an untrue running of the tensioned abrasive belts. Also, such wide belt grinding machines have already been connected with emergency power supply units serving at least to maintain the oscillatory control of the abrasive belt during power failures. However, these units are likewise relatively expensive and require constant servicing to keep them in operation. Therefore, the problem of a lateral untrue running of the abrasive belts in case of malfunctions has not as yet been solved satisfactorily.

SUMMARY OF THE INVENTION

Accordingly, it is an object of the present invention to improve conventional wide belt grinding machines so that, in the event of power disturbances such as electrical power failure or other electrical or mechanical malfunctions, the endless abrasive belts are arrested within a matter of seconds to avoid damage to or destruction of the abrasive belts and to eliminate danger to persons or property in proximity to the grinding machine.

To achieve the foregoing, the present invention offers two alternatives. One such alternative is to arrange a control member between the conventional control element and the two supply or feed lines connected to the cylinder for reversing the pressure force effective on the piston of the cylinder. The second embodiment replaces the conventional control element by an element which automatically reverses the pressure force action on the piston in the event of power failure. It has also been found particularly advantageous to use an electromagnetically switchable, spring-loaded 4/2-way valve as the additional control element or as the substitute control element having a pressure force-reversing effect. In either case, the abrasive belt can be slackened and, since it is in contact with the workpiece, arrested within a matter of a few seconds.

BRIEF DESCRIPTION OF THE DRAWING

These and other features, objects and advantages of the present invention will become readily apparent from the following description when taken in conjunction with the accompanying drawing which schematically shows, for purposes of illustration only, two embodiments of the present invention and wherein.

DETAILED DESCRIPTION OF PREFERRED EMBODIMENTS

Figure 1:
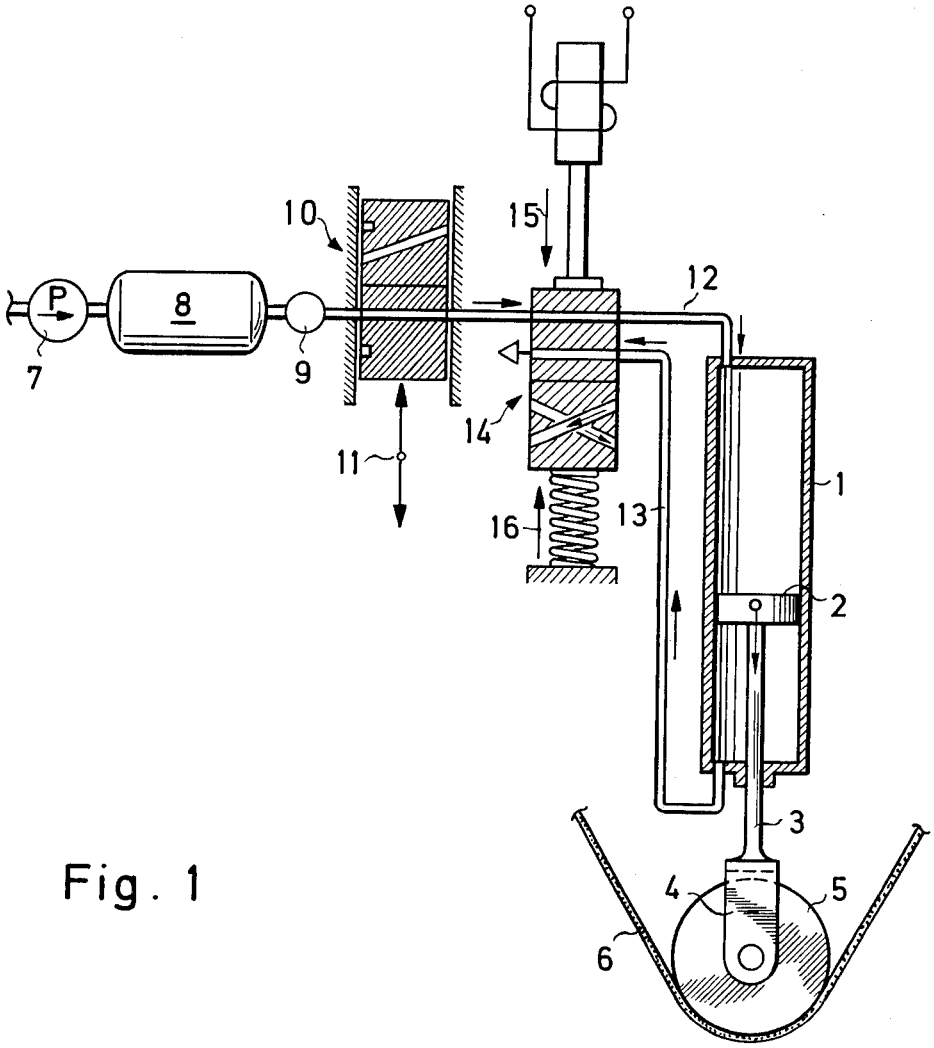
FIG. 1 schematically shows one embodiment of the present invention wherein a cylinder tensions one of the tensioning rolls and two control elements with the pressure supply source therefor, whereby the cylinder piston is in the position for tensioning an abrasive belt.

Referring now to the drawing and, in particular, FIG. 1, a piston 2 is guidably arranged in a cylinder 1 and includes a piston rod 3 carrying a tensioning roll 5 at the free end of the rod by means of a fork 4. The tensioning roll 5 serves to tension an abrasive belt 6 associated with a wide belt grinding machine. Heretofore, a manually controllable element 10, such as, for example, a two-way valve, had been provided between the cylinder 1 and a pump 7 with its associated pressure reservoir 8 and pressure regulator 9. With this arrangement and by, for example, pivoting a manual lever, it was possible, on one hand, to feed compressed air to one side of the piston 2 and, on the other hand, to relieve the pressure on the other side of the piston. This corresponds to the reciprocating movement of the control element 10 in the direction of arrows 11.

According to the present invention, applicants have provided an additional control valve 14 between the control element 10 and feed lines 12 and 13 connected to the cylinder 1. In this embodiment, the valve is switched electromagnetically and is a 4/2-way valve under the effect of a spring. When supplying electrical current to the control valve 14 upon actuation of the wide belt grinding machine, the electromagnetic field produced in the coil of this valve moves the valve 14 in the direction of arrow 15 to the position illustrated in FIG. 1. Since the control element 10 has already been pivoted manually into its operating position, compressed air can flow via the feed line 12 into the cylinder 1 so as to force the piston 2 in the direction of arrow 15 and allow the tensioning roll 5 to tension the abrasive belt 6. If for some reason electrical power is interrupted, the coil of the valve 14 is de-energized and the restoring force of the spring displaces the valve in the direction of arrow 16 so that compressed air is fed to the other side of piston 2 via the feed line 13 and the air from the other side of the piston 2 is exhausted to atmosphere via the feed line 12.

Figure 2:
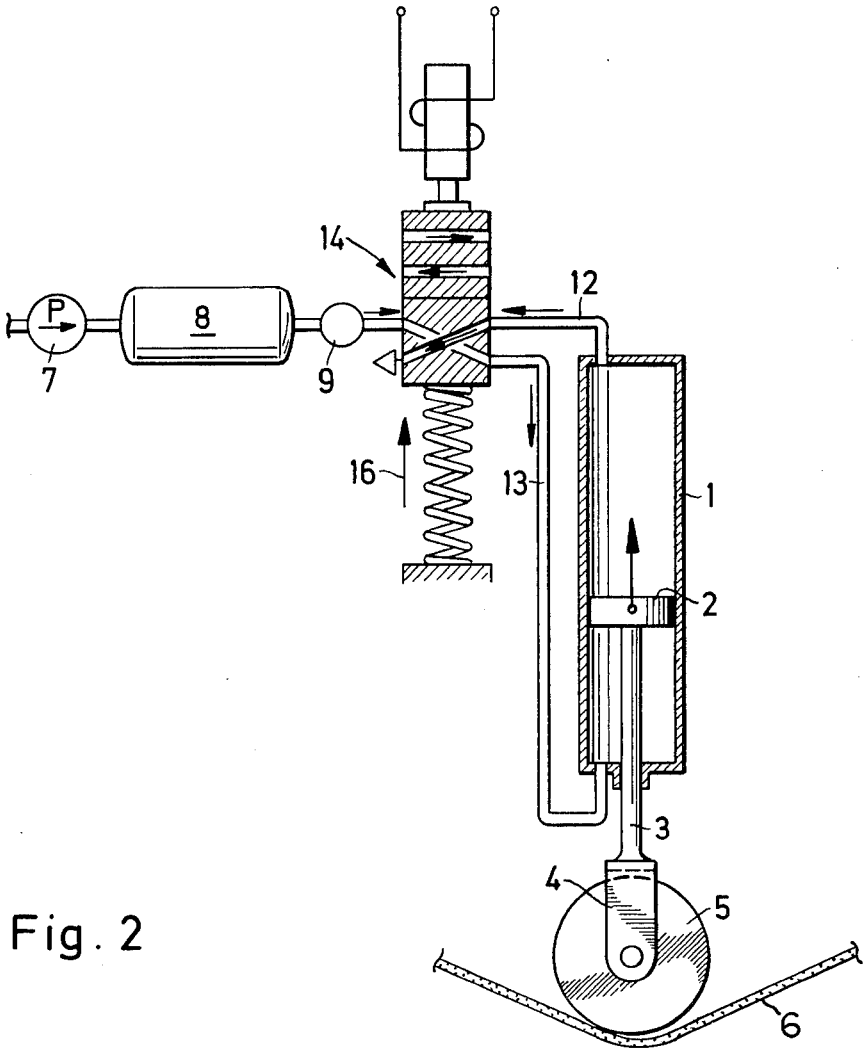
FIG. 2 schematically shows a tensioning roll cylinder according to a second embodiment of the present invention with only one control element wherein the tensioning roll associated thereof is in the relieved position.
Figure 3:
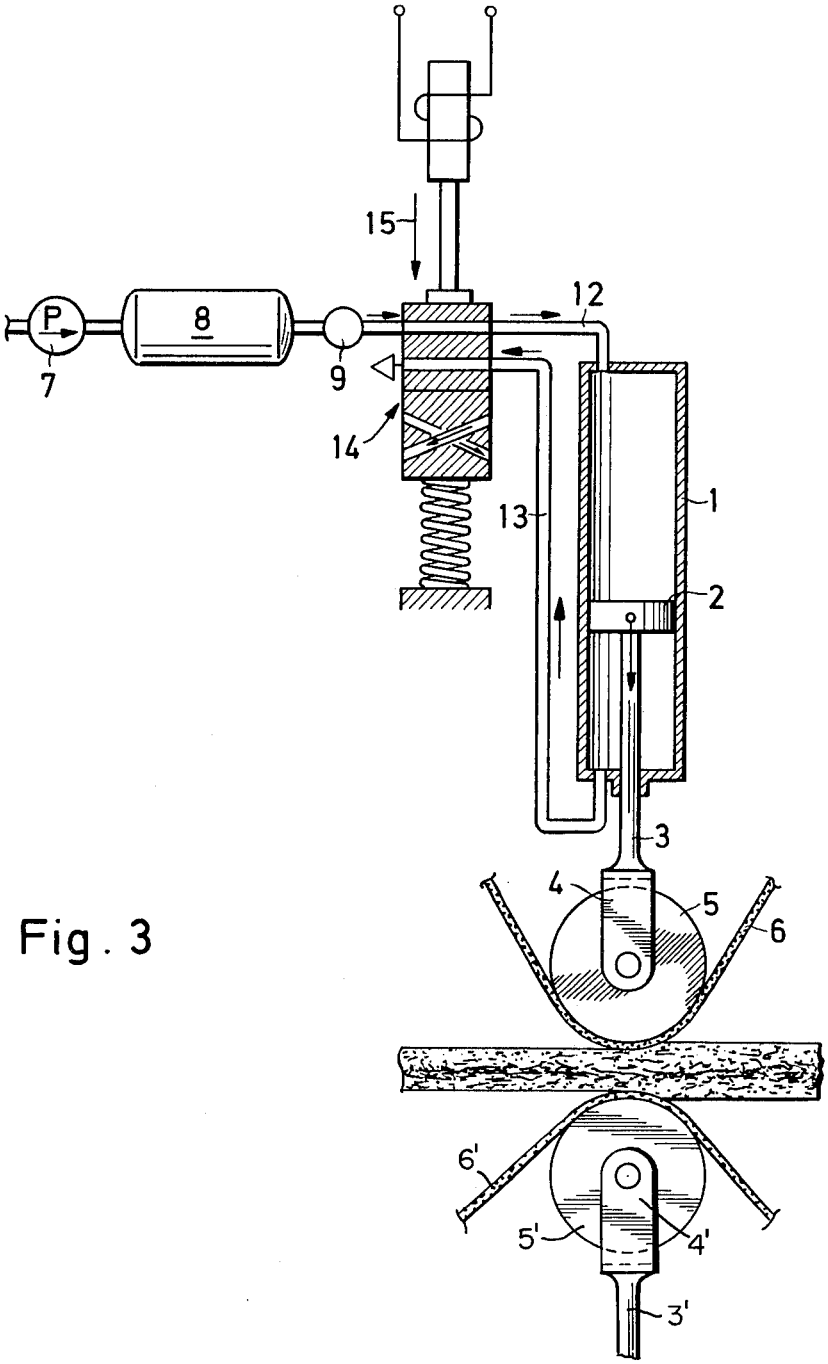
FIG. 3 schematically shows the embodiment of FIG. 2 with the tensioning roll placing an abrasive belt under tension.

FIGS. 2 and 3 show another embodiment of the present invention which has the advantage of being simple in construction. Like numerals are used in FIGS. 2 and 3 to designate parts identical with those of FIG. 1. FIG. 2 shows the situation where electrical power has been interrupted, e.g. a power failure, and the control valve 14 has caused the piston 2 to return and thereby move the tensioning roll 5 from the tensioned condition to the relieved condition. The control valve 14 is moved into the illustrated position immediately upon interruption of the electrical current and the compressed air is thus allowed to be introduced into cylinder 1 via the feed line 13. In case of power interruptions, the abrasive belt 6 is arrested or halted in about 4 seconds of power failure when executing a rough grinding operation or within 3 seconds of power failure when executing a fine grinding operation.

While we have shown and described several embodiments in accordance with the present invention, it is to be clearly understood that the same is susceptible of numerous changes and modifications as will be apparent to one skilled in this art. We, therefore, do not wish to be limited to the details shown and described herein but intend to embrace all such modifications as are within the scope of the appended claims.

We claim:

1. A wide belt grinding machine having at least one motor driven, endless abrasive belt; a cylinder; a dual controlled piston guidably arranged in the cylinder; a tensioning roll operatively connected with the piston for tensioning the abrasive belt; feed lines connecting the cylinder with a pressure source to effect the dual control of the piston; and control means associated with the feed lines for reversing the pressure force effective on the piston to relieve tension on the abrasive belt in the event of power failure.

2. A wide belt grinding machine according to claim 1, wherein a control element is provided between the pressure source and the control means to adjust the position of the piston in the cylinder during normal machine operation.

3. A wide belt grinding machine according to claim 1, wherein the control means adjust the position of the piston in the cylinder during normal machine operation.

4. A wide belt grinding machine according to claim 1, wherein the at least one abrasive belt is arranged above and/or below a plane in which a workpiece such as a wood panel is to be moved.

5. A wide belt grinding machine according to claim 1, wherein the control means comprises an electromagnetically switchable spring-loaded 4/2-way valve for reversing the pressure force.

6. A wide belt grinding machine according to claim 5, wherein a control element is provided between the pressure source and the control means to adjust the position of the piston in the cylinder during normal machine operation.

7. A wide belt grinding machine according to claim 5, wherein the control means adjusts the position of the piston in the cylinder during normal machine operation.

8. A wide belt grinding machine according to claim 6, wherein at least two abrasive belts are provided and are arranged above and below a plane in which a workpiece is to be moved.

9. A wide belt grinding machine according to claim 7, wherein at least two abrasive belts are provided and are arranged above and below a plane in which a workpiece is to be moved.

* * * * *